United States Patent [19]

Atack

[11] 4,276,939

[45] Jul. 7, 1981

[54] FIRE DETECTION AND EXTINGUISHING SYSTEMS

[75] Inventor: Joseph Atack, Huddersfield, England

[73] Assignee: Fire (Waterless Sprinklers) Limited, Guernsey, Channel Islands

[21] Appl. No.: 45,081

[22] Filed: May 16, 1979

[30] Foreign Application Priority Data

May 30, 1978 [GB] United Kingdom ..... 24056/78

[51] Int. Cl.[3] ..... A62C 37/18

[52] U.S. Cl. ..... 169/60; 169/26; 340/539

[58] Field of Search ..... 169/26, 60, 61, 23, 169/15, 16, 66, 19, 2 R; 340/600, 577, 584, 534, 539

[56] References Cited

U.S. PATENT DOCUMENTS

| | | | |
|---|---|---|---|
| 1,911,166 | 5/1933 | Schwepcke | 169/60 |
| 2,559,634 | 7/1951 | Keese, Jr. | 169/60 |
| 3,752,235 | 8/1973 | Witkowski | 169/26 |
| 3,990,518 | 11/1976 | Hemme | 169/60 |
| 4,101,887 | 7/1978 | Osborne | 169/60 |
| 4,109,239 | 8/1978 | Davis | 340/539 |
| 4,160,246 | 7/1979 | Martin | 340/539 |

FOREIGN PATENT DOCUMENTS

| | | | |
|---|---|---|---|
| 2105531 | 4/1972 | France | 169/60 |

*Primary Examiner*—David A. Scherbel
*Assistant Examiner*—Kenneth Noland
*Attorney, Agent, or Firm*—Norris & Bateman

[57] ABSTRACT

A fire detecting and extinguishing apparatus comprises a plurality of detectors mounted above the areas to be protected, a centrally arranged receiver to pick up electric signals or a different frequency from each detector an emitter to which the signals are fed and which diseminates further signals of differing frequencies, and switches each tuned to one of the frequencies of the further signals to receive the further signals from the emitter and solenoids energized by the switches, a platform actuated by each solenoid, a pressurized cylinder, and a valve on the cylinder onto which operates when a weight falls to release a powder or mist from the cylinder to blanket the fire.

1 Claim, 4 Drawing Figures

FIRE DETECTION AND EXTINGUISHING SYSTEMS

This invention relates to improvements in fire detecting and extinguishing apparatus of the type in which a weight is connected to a therme plastics line cable or filament, one end of which is affixed to a stationary point and adapted to fail structurally on heating to a predetermined temperature to release the weight.

The object of the present invention is to detect a fire electronically to operate the release of a platform to allow a weight to fall therefrom to actuate a cylinder to release a powder or mist to blanket the fire.

The invention comprises a detector mounted above the area to be protected to emit signals picked up by a centrally arranged receiver tuned to pick up signals of differing frequencies from each detector, the receiver emitting further signals to operate individual switches each tuned to a different frequency to energize solenoids or other electrical devices to allow a platform to pivot to cause a weight to fall to operate a valve on a pressurised cylinder to release powder or mist to blanket the fire.

The invention will be described with reference to the accompanying drawings.

Figure 1:
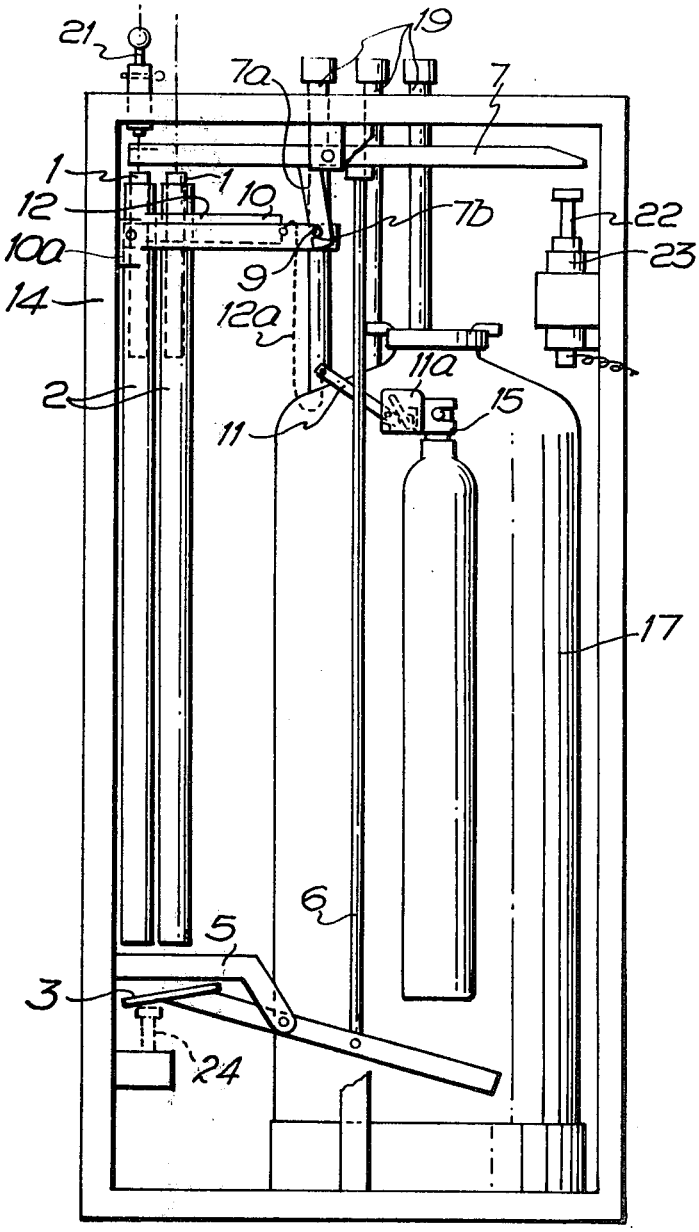
FIG. 1 is a side elevation showing the apparatus in the inoperative position.

A plurality of lines, cables or filaments of nylon or other therme plastics material are suspended adjacent a wall or ceiling of a building, one end of each line, cable or filament being affixed to the wall or ceiling and the other end passing over a guide (not shown) and having a weight 1 attached thereto.

The weights 1 each hang in a chute or tube 2 above an inclined platform 3 pivoted on a bracket 5. A push rod 6 is pivoted on the platform 3 and when a weight 1 falls onto the platform 3 the rod 6 is raised to rock a lever 7, pivoted intermediate its ends. An arm 7*a* formed with a notch 7*b* is mounted to depend from the lever 7 the notch 7*b* housing a pin 9 mounted to extend horizontally from a second platform 10 pivoted on bracket 10*a* mounted on a casing 14 for the apparatus. A further weight 12 is carried on the platform 10 connected by a chain 12*a* to one end of a lever 11 pivoted intermediate its ends on a bracket 11*a* affixed to the head 15 of a cylinder of $CO_2$ or nitrogen or other inert gas under pressure.

Figure 2:
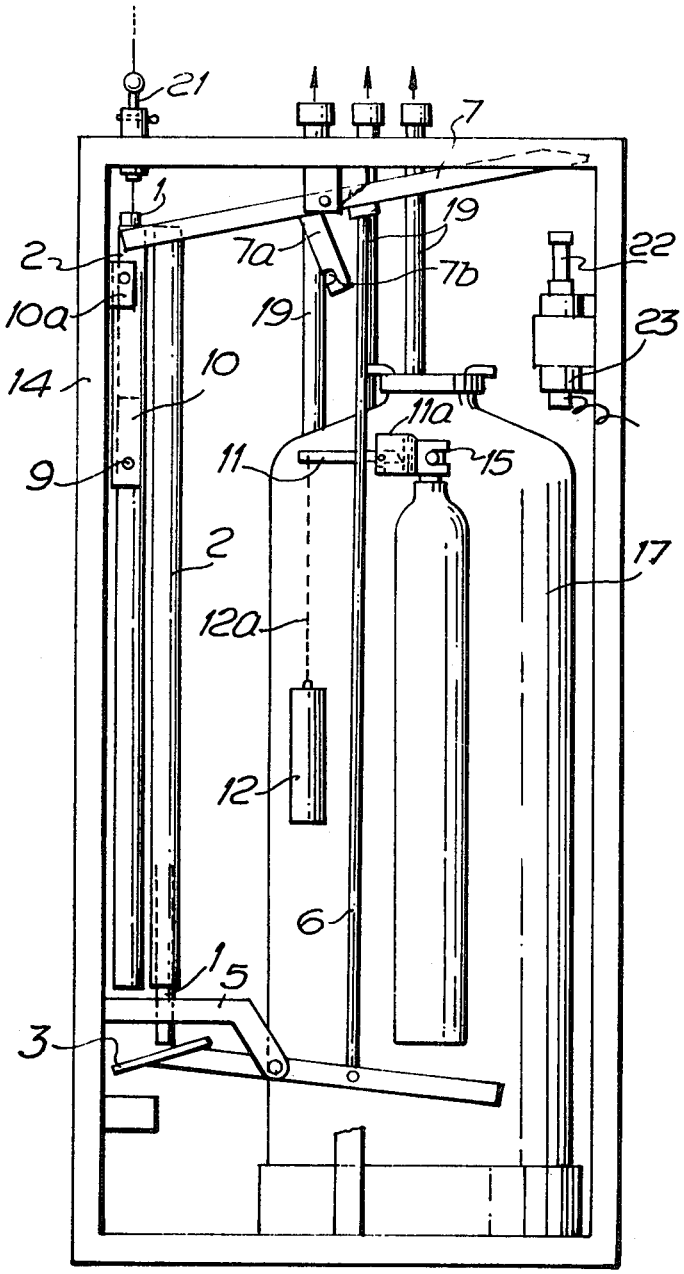
FIG. 2 is a similar view showing the apparatus of FIG. 1 in the operative position.
Figure 3:
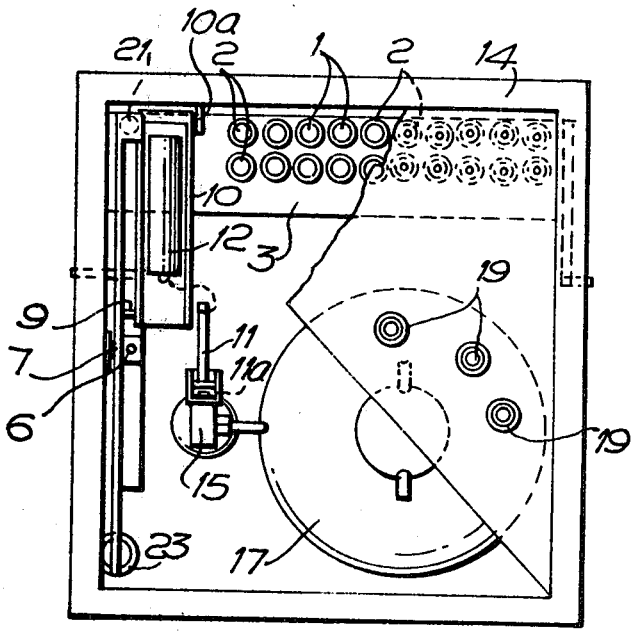
FIG. 3 is a plan of the apparatus of FIG. 1.
Figure 4:
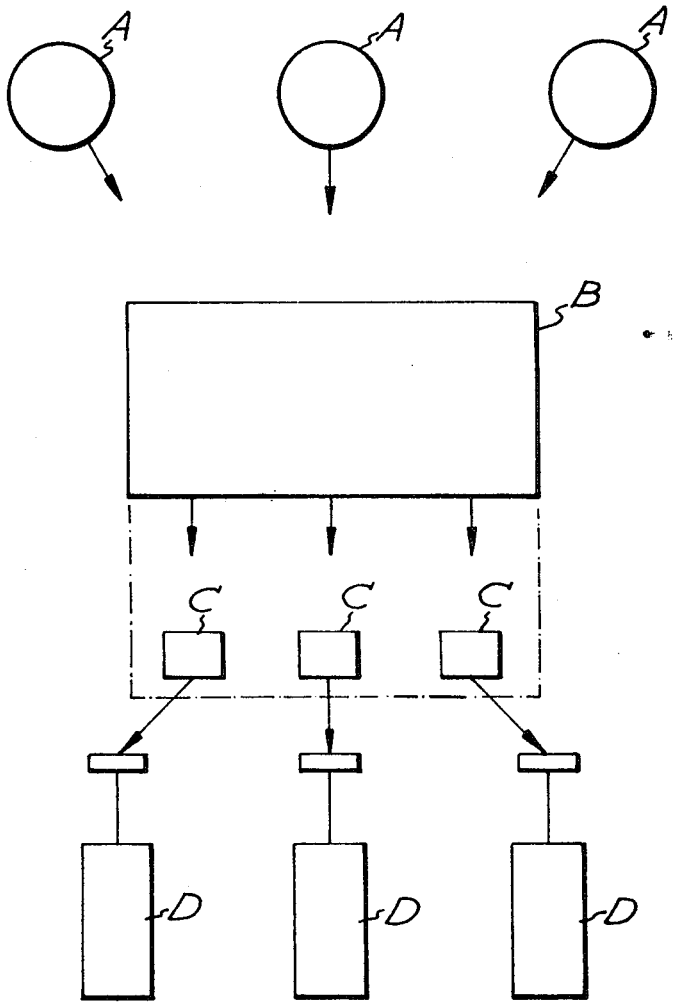
FIG. 4 is a diagram illustrating diagrammatically the detecting devices.

To operate the extinguishing apparatus the lever 7 is rocked by the rod 6 when a weight 1 falls onto the platform 3 causing the platform to pivot and raise the rod 6 as shown in FIG. 2. The rocking of the lever 7 removes the arm 7*a* from the pin 9 which allows the platform 10 to pivot and the weight 12 to fall, the chain 12*a* tightens and the lever 11 pivots to bring the free end into contact with a rod (not shown) slidable in the cylinder head 15 to open a valve in the cylinder and allow gas to pass into and pressurize a second cylinder 17 containing an inert non-toxic fire extinguishment powder or gas. The weight 12 and lever 11 hold the valve in the head 15 open and until the weight 12 is lifted.

After being operated the severed line, cord or filament is replaced and the weight 1 is suspended therefrom; the lever 7 is restored to its initial position and the platform 3 and rod 6 are reset.

The lever 7 is mounted substantially horizontally and may be stabilised by a spring detent (not shown) connected between the free end of the lever 7 and the frame 14.

The lever 7 may be manually operated by actuating a lever 21 mounted to rock the lever or it may be rocked by the piston 22 of a solenoid 23. The solenoid is energised by a battery and operated by a switch actuated by a smoke or heat or gas sensitive electronic detector system, the detectors may be connected by a multi core cable, one strand actuating a smoke detector and further strands operating a heat detector and a gas type sensitive electronic detector. The apparatus may also actuate a sprinkler system and operate relays to release fire exit doors or step machinery or forced draught fans.

The non-toxic gas or powder on pressurization escapes through a delivery valve (not shown) from the cylinder 17 and passes along pipes or tubes 19. The pipes or tubes 19 are branched and supported in the area to be protected. The support for the branches is preferably away from the delivery end of the pipes or tubes which may be of a plastic material in order that when the contents of the second cylinder 17 pass therethrough under pressure the free ends of the pipes or tubes will wave about and thus distribute the cloud or mist over a larger area, or the ends of the pipes or tubes may be oscillated by mechanical or other means.

In order to prevent the pivoting of the platform 3 during installation or repair of the apparatus a pin 24 is provided to lock the platform to prevent it from falling if any one of the weights 1 is released.

The following is an example of a powder for providing the mist or gas cloud:

Magnesium stearate, Mg $(C_{17}H_{35}COO)_2$=0.83%
Magnesium carbonate, as $MgCO_3$,=0.56%
Sodium bicarbonate, to make up to 100%

The total magnesium content is determined using an E.D.T.A. titration, and by subtracting the centribution from the stearate to give residual magnesium, which was calculated as magnesium carbonate, $MgCO_3$.

The power in solution has a pH of 8.5, which excludes the possibility of much soluble carbonate being present. Magnesium stearate was determined by boiling a portion with dilute acid to dissolve the carbonate and bicarbonate. The insoluble matter was separated, dried and weighed. Infra-red examination indicated that this substance was stearic acid, as expected; this residue was calculated as magnesium stearate.

The powder is white and free flowing and when released forms an inert non-toxic mist which envelopes any fire and insulates unburnt material.

A plurality of detectors A are mounted above the area to be protected.

The detector A contains a radio active material AMERICIUM 241 of less than 3 micro Curies. Under normal conditions air currents flow through two independent chambers in the ceiling mounted detectors A and is recorded in a receiver control unit B. In a fire situation whether smouldering or blazing, the molecules of air expand due to heat and the flow of current into the two chambers which were balanced become unbalanced by the bigger molecules. This interferes with the current flow and causes a voltage drop. It is this voltage drop that then triggers off a signal which is sent to the receiving station B. From this station is transmitted a signal which causes the discharge of an automatic fire fighting dry chemical which is harmless to humans, plants, feed and other materials.

One of the two chambers of the unit B analyses any change of atmosphere, and the second chamber checks the change to ensure that it is not of a merely transient nature and if the change is found to be of a permanent nature a signal of a particular frequency is emitted. Each detector A is tuned to emit a signal of a different frequency. The detector A emits a signal which is picked up by the receiver control unit B which emits a further signal which is picked up by a switch receiver circuit C operating a solenoid S or other device to tip the platform 10. The weight 12 is carried on the platfrom connected by a chain 12*a* to one end of the lever 11 pivoted intermediate its ends affixed to the head of a cylinder D of $CO_2$ or Nitrogen or other inert gas under pressure.

Each detector A emits a signal of a slightly different frequency which is picked up by the receiver control B tuned independently to each detector frequency.

The receiver control emits a signal of a particular frequency to be picked up by a receiver tuned to receive this particular frequency and energises mechanism such as the solenoids to allow the platform to pivot. The particular cylinder receiver is that nearest to the fire selected by the receiver control B, from the signal picked up from the detector A actuated by the change of atmosphere.

If the fire is located between two detectors A both may be affected by the change of atmosphere and both cylinders D adjacent to the fire will be actuated.

What I claim is:

1. Fire detecting and extinguishing apparatus comprising a plurality of individual detectors arranged at respective areas to be protected, each of said detectors emitting an electrical signal of a different frequency from the others when energized by fire, a central receiver having means for receiving each different frequency signal and emitting an electrical switching signal of corresponding frequency, a plurality of switch means each tuned to receive a different one of said switching signals and a solenoid operably connected to each switch means, a plurality of pressurized cylinder assemblies containing fire treatment fluid located in the respective areas, each cylinder assembly having a discharge valve, and means operably connecting each solenoid to the discharge valve of the associated cylinder assembly whereby upon energization of a particular detector a fire treating fluid will be discharged from a cylinder assembly in that area, said last-named means providing a plurality of movably mounted platforms, one at each cylinder assembly, with each of said solenoids operatively connected to displace a different one of said platforms when actuated by the switching signal, and there being a weight on each platform connected to the associated cylinder discharge valve and adapted to fall and open that valve when the associated platform is displaced.

* * * * *